United States Patent [19]

de Koning

[11] 4,172,617

[45] Oct. 30, 1979

[54] SUCTION DREDGER VESSEL AND METHOD OF LOADING THE HOLD OF THE SAME

[75] Inventor: Jan de Koning, Amsterdam, Netherlands

[73] Assignees: Ingenieursbureau voor Systemem en Octrooien "Spanstaal" B.V., Ballast-Nedam Groep N.V., Amsterdamse Ballast Bagger en Grond (Amsterdam Ballast Dredging) B.V., Amstelveen; Scheepswerf en Machinefabriek "De Liesbosch" B.V., Nieuwegein, both of Netherlands
Netherlands

[21] Appl. No.: 913,319

[22] Filed: Jun. 7, 1978

Related U.S. Application Data

[63] Continuation of Ser. No. 740,759, Nov. 10, 1976, abandoned.

[30] Foreign Application Priority Data

Nov. 12, 1975 [NL] Netherlands ..... 7513264

[51] Int. Cl.[2] ..... B63B 27/00

[52] U.S. Cl. ..... 406/23; 37/58; 114/26; 406/109; 137/566; 414/138

[58] Field of Search ..... 214/12, 13, 15 A, 15 B, 214/152; 114/26, 27, 121; 37/54, 58, 59; 137/566, 147; 302/3, 14

[56] References Cited

U.S. PATENT DOCUMENTS

| | | | |
|---|---|---|---|
| 2,263,300 | 11/1941 | Haverley | 137/147 |
| 3,630,400 | 12/1971 | De Koning | 37/58 |

FOREIGN PATENT DOCUMENTS

| | | | |
|---|---|---|---|
| 2522469 | 5/1975 | Fed. Rep. of Germany | 114/27 |

*Primary Examiner*—Trygve M. Blix
*Assistant Examiner*—George F. Abraham
*Attorney, Agent, or Firm*—John P. Snyder

[57] ABSTRACT

In a method of loading the hold of a suction dredger vessel, in which a suspension of sand and water is pumped into the hold during loading which is carried out in a first stage and a subsequent second stage for avoiding that a siphon effect is not possible and that the last quantity of water cannot be replaced by a sand-water mixture, the effluent means are kept, after the suspension level in the hold has reached the external water level, under the action of a suction pump for lowering the suspension level to below the external water level.

7 Claims, 2 Drawing Figures

SUCTION DREDGER VESSEL AND METHOD OF LOADING THE HOLD OF THE SAME

Figure 1:
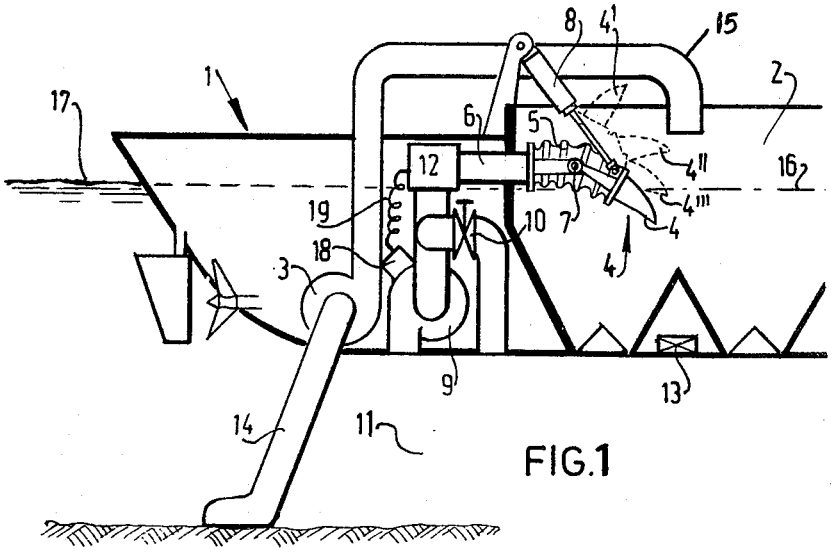

This is a continuation, of application Ser. No. 740,759 filed Nov. 10, 1976 now abandoned.

The invention relates to a method of loading the hold of a suction dredging vessel in which a suspension of sand and water is pumped into the hold during a loading operation which is carried out in at least two stages i.e.

- a first stage in which effluent means are held at such a high level that the hold is essentially loaded up to its maximum volume with the suspension of sand and water, and
- a subsequent second stage in which the effluent means are lowered and simultaneously additional suspension is pumped into the hold, in which first stage suspension is pumped into the hold until the suction dredger is essentially loaded up to its maximum admissible loading capacity and in the subsequent second stage the effluent means are lowered in dependence upon the weight of the load of the hold to an extent such that the suction dredger remains essentially loaded up to its maximum admissible loading capacity as disclosed in Dutch Pat. No. 138,182.

When the level of the water or of the water-sand mixture above the settled sand drops down, this suspension level may arrive below the external water level so that a siphon effect is no longer possible and in fact the last quantity of water cannot be replaced by a sand-water mixture. In order to eliminate this disadvantage the invention provides an improvement in the method disclosed in Dutch Pat. No. 138,182 in that at least after the suspension level in the hold has reached the level of the external water the effluent means are kept under the action of a suction pump in order to lower the suspension level to below the external water level.

It should be noted that it may be considered to be common practice in dredging techniques to conduct away water located above settled sand from the hold of a dredger. This is disclosed, for example, in French Pat. No. 386,251, from which publication a dredging vessel is known, in which subatmospheric pressure is maintained in a loading space so that a dredging pump in the conduit between the suction nozzle and the loading space can be dispensed with. The subatmospheric pressure is maintained by sucking away the water collected above the settled sand with the aid of a suction pump.

From Dutch Pat. application No. 7,113,102, laid up for public inspection, a submerged loading space is known, in which the water located above the settled sand in the loading space is sucked away by means of a suction pump. From these two publications there can be derived no means relating to a method in which the ship is loaded in a first stage up to the maximum admissible carrying capacity and is held in this state in a second loading stage by the controlled effluence of water located above settled sand.

The improvement furthermore relates to and provides a suction dredging vessel comprising a hold, a pump for pumping a sand-water suspension into the hold and effluent means, which can be adjusted in a first loading stage at a high level corresponding to the maximum volume of the hold and in a second loading stage on a lower level, whilst for carrying out the method embodying the invention the volume of the hold is so large that the suction dredger can be loaded in a first stage with a sand-water mixture essentially up to its maximum admissible loading capacity and comprising control-means for a progressive lowering of the effluent means during the second loading stage in dependence upon load measuring means, said suction dredging vessel being characterized in that a suction pump is provided in the communication between the effluent means and the external water.

It should be noted that it is known from Dutch Pat. No. 96,078 to fill a hopper arranged on board of a dredging vessel with a mixture of water and sand, in which the overflowing water still containing a small quantity of sand is conducted away with the aid of a suction pump. With this suction dredging vessel an enriched sand-water mixture is sprayed into the ground near the suction nozzle in order to obtain a higher concentration of solid substance during the upward suction operation.

The aforesaid and further features of the invention will be described more fully with reference to a drawing.

Figure 2:
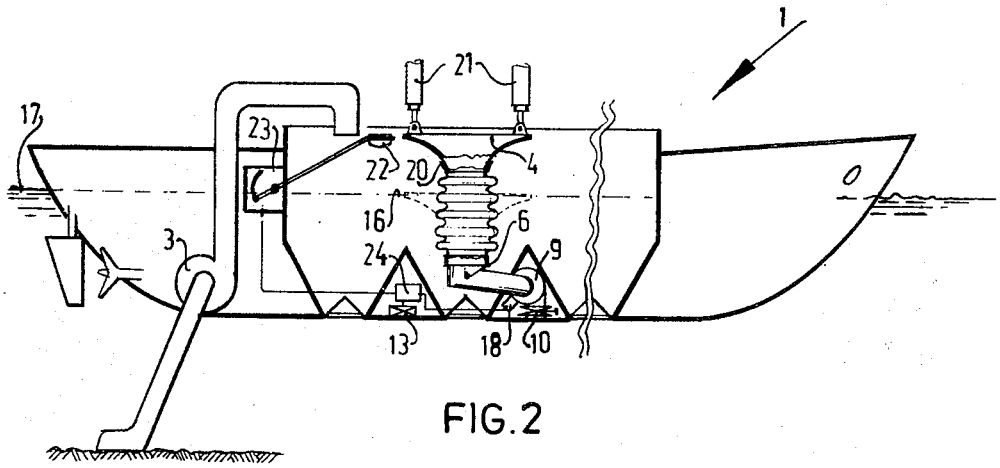

In the drawing:

FIGS. 1 and 2 are each a schematic longitudinal sectional view of two different suction dredging vessels embodying the invention.

FIG. 1 shows part of the suction dredger vessel 1 described in the Dutch Pat. No. 138,182 and comprising a hold 2, a pump 3 for pumping a sand-water suspension through a suction duct 14 and a pressure duct 15 into the hold 2 and effluent means. The effluent means shown in FIG. 1 are formed by an affluent nozzle 4 communicating through a flexible conduit 5 with an effluent duct 6 and being pivotable about a hinge 7 by means of a hydraulic cylinder 8. The effluent duct 6 communicates via a suction pump 9 and a closing member 10 with the external water 11. The effluent duct 6 is provided with a velocity meter 12. The suction dredger 1 formed by a trailing dredger comprises further a load meter 13 for measuring the weight of the load, for example, in dependence upon the dipping depth of the suction dredger 1 in the external water 11. The hold 2 is loaded in two stages, in both of which a sand-water suspension is pumped into the hold 2. In the first stage the hold 2 is essentially loaded with suspension to the maximum volume, whilst as the case may be some water is already conducted away from the hold 2 via an idle suction pump 9 and an open closing member 10, the affluent nozzle 4 being, however, kept in or substantially in the highest position 4' in order to maintain a large volume of the hold 2. When the load meter 13 indicates that the suction dredger 1 is loaded up to its maximum admissible loading capacity, the second loading stage begins, in which the affluent nozzle 4 is gradually lowered, whilst simultaneously additional suspension is pumped into the hold 2. The affluent nozzle 4 is lowered in dependence upon the weight of the load in the hold 2 to an extent such (see position 4'') that the dredger 1 essentially remains loaded up to its maximum permissible loading capacity.

After the affluent nozzle 4 has reached the position 4''', in which the suspension level 16 is level with the external water surface 17, the velocity meter 12 generates a signal because the velocity in the effluent duct 6 has become zero. This signal is used for an automatic start of the suction pump 9. For this purpose the control-member 18 for starting the suction pump 9 is subject to the velocity meter 12 forming a feeler through an electric conductor 19. The suction pump 9 ensures that the suspension level 16 can drop below the level of the external water 17, the affluent nozzle 4 then reaching the position 4.

The suction dredger 1 shown in FIG. 2 differs from the suction dredger 1 shown in FIG. 1 in that the affluent nozzle 4 is formed by an overlap rim of a telescopic tube 20 displaceable in a stationary delivery pipe 6, which tube can be set at different levels by means of hydraulic cylinders 21. The feeler means of FIG. 2 are formed by a float 22, whose pivotal position determines the electrical resistance of a potentiometer 23, whose output signal together with the output signal of the load meter 13 is fed to a comparator 24, the output of which energizes the actuating member 18 of the suction pump 9 for starting the same when the suspension level 16 approaches the external water level 17.

What we claim is:

1. The method of loading the hold of a suction dredging vessel with a maximum weight of settled sand in the substantial absence of a residual water level which lies above the level of the settled sand, which comprises the steps of:

(a) pumping a suspension of sand in water into the hold of a dredging vessel, which hold extends from a level below the external water surface to a level above the external water surface and which has a volumetric capacity exceeding that volume of settled sand which represents the weight loading capacity of the vessel, to provide an ascending level of water within the hold and an ascending level of settled sand below such ascending water level in the hold;

(b) measuring the increasing load contained in said hold due to the suspension pumped in step (a) and draining off water, which may contain some sand, at and when said ascending level thereof reaches a first level within said hold, which first level is above said external water surface, until said weight loading capacity has been reached;

(c) continuing said draining off while lowering the level of such draining off within said hold below said first level substantially to maintain said weight loading capacity as measured in step (b) until the level of draining off has been lowered substantially to the level of said external water surface; and then (d) replacing the draining off with suction removal when the condition of step (c) has been reached, and continuing the lowering of the level of suction removal substantially to maintain said weight loading capacity as measured in step (b) until the lowering level of suction removal has substantially reached the ascending level of settled sand within said hold, whereby said maximum weight of settled sand substantially equals said weight loading capacity of the vessel.

2. In a suction dredging vessel including a hold having a volumetric capacity exceeding that volume of settled sand which represents the weight loading capacity of the vessel, said hold extending from a level below the external water surface to a level above such external water surface, and pump means for pumping a suspension of sand in water into said hold to provide an ascending level of water within said hold and an ascending level of settled sand below such ascending level of water in the hold, the combination of:

a nozzle initially positioned at a first level near the top of said hold, actuating means for selectively lowering and raising said nozzle, and duct means connecting said nozzle to the external water below the level thereof;

a suction pump carried by said vessel and having an inlet connected to said nozzle and an outlet discharging to said external water, and valve means in said duct means for normally making fluid connection between said nozzle and said duct means;

measuring means carried by said vessel for determining the weight of material contained in said hold;

said actuating means being controlled by said measuring means to lower said nozzle toward the level of the external water when said measuring means indicates that the load in said hold is substantially at the weight loading capacity of the vessel, whereby said ascending level of water in the hold is caused to drain off through said nozzle and duct means toward the level of said external water while the level of settled sand continues to ascend; and means determining when said descending level of water in the hold has reached said level of the external water for actuating said valve means to interrupt fluid connection between said suction pump and the duct means for energizing said suction pump while allowing said actuating means to continue lowering of said nozzle, whereby the descending water level in the hold reaches the ascending level of settled sand and the ascending level of settled sand reaches that level substantially corresponding to said weight loading capacity of the vessel.

3. In the suction dredger as defined in claim 2 wherein the means last mentioned comprises a fluid velocity sensor in the fluid connection between said nozzle and the duct means.

4. In the suction dredger as defined in claim 2 wherein the means last mentioned comprises a float within said hold.

5. The method of loading the hold of a suction dredging vessel with a maximum weight of settled sand in the substantial absence of residual water level which lies above the level of the settled sand, which comprises the steps of:

(a) providing a hold in the vessel which has a vertical height greatly in excess of that required to accommodate that maximum level of settled sand which corresponds to the maximum loading capacity of the vessel, whereby to provide ample hold capacity to permit good separation between the settled sand and water as the settled sand level is rising toward said maximum level, said hold being disposed in the vessel such that said maximum level will always lie below the level of external water when the vessel is so loaded;

(b) pumping a suspension of sand in water into said hold to provide an ascending level of water within said hold and an ascending level of settled sand below such ascending water level;

(c) measuring the increasing load contained in said hold due to the suspension pumped in step (b) and draining off water when it reaches a level above said external water level until said maximum loading capacity of the vessel is reached;

(d) continuing said draining off while lowering the level of such draining off within said hold below said first level substantially to maintain said weight loading capacity as measured in step (c) until the level of draining off has been lowered substantially to the level of said external water surface; and then (e) replacing the draining off with suction removal when the condition of step (d) has been reached, and continuing the lowering of the level of suction removal substantially to maintain said weight loading capacity as measured in step (c) until the lowering level of suction removal has substantially reached the ascending level of settled sand within said hold, whereby said maximum weight of settled sand substantially equals said weight loading capacity of the vessel.

6. In a suction dredging vessel, the combination of:

a vessel having a hold, said hold having a vertical height which greatly exceeds that maximum level of settled sand therein which corresponds to the maximum loading capacity of the vessel, and said hold being so located in the vessel that said maximum level of settled sand will always lie below the level of external water when the vessel is loaded, whereby good separation between the settled sand and water is achieved;

pump means for pumping a suspension of sand in water into said hold;

a drain nozzle normally located near the top of said hold and duct means normally connected with said nozzle means for allowing water which has reached the level of said drain nozzle to drain back into said external water whereby the water level remains stationary while the level of settled sand continues to rise in the hold;

a suction pump connected to said drain nozzle;

means for lowering said drain nozzle within said hold;

measuring means for lowering said drain nozzle when the contents of said hold correspond to the maximum loading capacity of the vessel whereby to lower said water level in the hold toward said maximum level of settled sand;

means for determining when said drain nozzle has reached the level of the external water; and means actuated by the means last mentioned for energizing said suction pump and for blocking off said duct means while allowing said drain nozzle to continue its lowering until said drain nozzle and said ascending level of settled sand have at least substantially reached said maximum level.

7. The method of loading the hold of a suction dredging vessel with a maximum weight of settled sand in the substantial absence of a residual water level which lies above the level of the settled sand, which comprises the steps of:

(a) pumping a suspension of sand in water into the hold of a dredging vessel, which hold extends from a level below the external water surface to a level above the external water surface and which has a volumetric capacity exceeding that volume of settled sand which represents the weight loading capacity of the vessel, to provide an ascending level of water within the hold and an ascending level of settled sand below such ascending water level in the hold;

(b) measuring the increasing load contained in said hold due to the suspension pumped in step (a) and removing water from the hold, at and when said ascending level thereof reaches a first level within said hold, which first level is above said external water surface, until said weight loading capacity has been reached;

(c) continuing the water removal of step (b) while lowering the level of such removal within the hold below said first level substantially to maintain said weight loading capacity as measured in step (b) until the level of water removal has been lowered substantially to the level of said external water surface;

(d) continuing the lowering of the level of water by suction removal, when the condition of step (c) has been reached, substantially to maintain said weight loading capacity as measured in step (b) until the lowering level of suction removal has substantially reached the ascending level of settled sand within the hold, whereby said maximum weight of settled sand substantially equals said weight loading capacity of the vessel.

* * * * *